US006192807B1

(12) United States Patent
Mason

(10) Patent No.: US 6,192,807 B1
(45) **Date of Patent: *Feb. 27, 2001**

(54) PALLET PROTECTOR ASSEMBLY

(75) Inventor: Allen Mason, Palm Beach, FL (US)

(73) Assignee: Food Machinery Equipment Corporation, Palm Beach, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/411,762

(22) Filed: Oct. 4, 1999

(51) Int. Cl.[7] ..... B65D 19/00
(52) U.S. Cl. ..... 108/51.11; 108/55.1; 108/27
(58) Field of Search ..... 108/51.11, 57.12, 108/57.25, 27, 901, 902, 55.1; 248/345.1

(56) References Cited

U.S. PATENT DOCUMENTS

| | | | | |
|---|---|---|---|---|
| 1,918,634 | * | 7/1933 | Cordes | 108/27 X |
| 2,420,640 | * | 5/1947 | Acteson | 108/55.1 X |
| 3,181,176 | * | 5/1965 | Nagy et al. | 108/27 X |
| 4,292,899 | | 10/1981 | Steffen . | |
| 4,635,562 | * | 1/1987 | Kreeger | 108/55.1 |
| 4,715,294 | | 12/1987 | Depew . | |
| 5,076,175 | | 12/1991 | Whatley, II . | |
| 5,180,134 | * | 1/1993 | Mallak | 108/55.1 X |
| 5,496,609 | * | 3/1996 | Michelstein | 108/27 X |
| 5,609,111 | * | 3/1997 | Hasegawa et al. | 108/55.1 |
| 5,673,629 | | 10/1997 | Ginnow . | |

FOREIGN PATENT DOCUMENTS

| | | | | |
|---|---|---|---|---|
| 3618357 | * | 10/1987 | (DE) | 108/27 |
| 762007 | * | 11/1956 | (GB) | 108/55.1 |
| 3143612 | * | 6/1991 | (JP) | 108/27 |

* cited by examiner

*Primary Examiner*—Jose V. Chen
(74) *Attorney, Agent, or Firm*—Caesar, Rivise, Bernstein, Cohen & Pokotilow, Ltd.

(57) ABSTRACT

A pallet protector assembly for use with a conventional pallet, e.g., a wooden pallet having a plurality of stringers disposed generally parallel to one another between upper and lower decks formed of plural spaced-apart deck-boards. The pallet has a pair of sides and a pair of ends. The pallet protector assembly comprising plural, e.g., four, elongated bar-like, hollow plastic, guard members, each which has an opposed pair of end portions. Each end portion of each guard member includes a respective connector. Both of the connectors of two of the guard member are bulbous key-like projections. Both of the connectors of the other two of the guard members are mating key-slot shaped recess. The bulbous key-like projections of the two guard members are arranged to be releasably received within respective recesses of the other two guard member to releasably secure the guard members to one another to form a self-supporting frame encircling the periphery of the pallet. The connectors forming the guard members are resistant to accidental disconnection from each other so that the protector assembly when in place is resistant to accidental disconnection. However, any guard member can be readily purposely removed from the others to provide access to any portion of the pallet, e.g., access to an end portion to enable the pallet to be lifted by the tines of a conventional fork-lift machine.

30 Claims, 2 Drawing Sheets

PALLET PROTECTOR ASSEMBLY

BACKGROUND OF THE INVENTION

This invention relates generally to pallets for supporting materials, and more particularly to a protector or guard device which is arranged to be readily disposed about the periphery of a pallet to protect the pallet and persons coming into contact with the pallet.

In U.S. Pat. No. 4,715,294 (Depew) there is disclosed a pallet construction making use of protective members fabricated out of metal, plastic or other impact resistant material for engaging two opposed end portions of the pallet to protect against damage. The protective members are in the form of upper and lower elongated bars and associated cap portions. The to protective members are arranged to be secured in place to the pallet, via nails or screws, with the bars extending flush with the top and bottom surfaces of the upper and lower deck-boards, and with the cap portions embracing the end portions of the stringers or other deck-board supporting components. The cap portions are secured to the embraced portions beneath the deck-boards. Flanges may be provided on the cap portions at the end of the protective members for direct securement to the upper surface of the deck-boards and to the under surface of the underlying portion of the pallet. With pallets of block type construction, side protective members may be included to be nailed, screwed or otherwise secured to sides of the pallet, whereupon the periphery of the pallet is protected.

While the pallet protective members of the Depew patent may be generally suitable for their intended purposes of protecting the pallet from damage by a fork-lift apparatus used to lift and transport the pallet, they still leave much to be desired from various standpoints, e.g., inability to cover the entire periphery of the pallet, complexity of construction, inability to be readily removed from the pallet.

Other pallet protectors have been disclosed in the patent literature. For example, U.S. Pat. No. 4,292,899 (Steffen) discloses a protective element for a pallet in the form of a plate, preferably formed of sheet metal for a fixation to deleting stringer of the pallet. The plate-like element is preferably nailed to the pallet.

U.S. Pat. No. 5,076,175 (Whatley, II) also discloses a protective plate for use with a pallet. The plates may include perforations or holes to receive fasteners such as nails for fixing the plate to the pallet. The plates are disclosed as being fabricated from sheet metal.

U.S. Pat. No. 5,673,629 (Ginnow) discloses an end cap construction for protecting the ends of the stringers of a pallet Each of the end cap construction units is a generally U-shaped member having plural apertures therein.

The pallet protectors disclosed in these patents suffer from many of the same disadvantages as that of the Depew patent discussed above.

OBJECTS OF THE INVENTION

Accordingly, it is a general object of this invention to provide a pallet protector which overcomes the disadvantages or limitations of the prior art.

It is another object of this invention to provide a pallet protector which can be readily assembled.

It is another object of this invention to provide a pallet protector which can be readily disassembled.

It is another object of this invention to provide a pallet protector which when assembled is self supporting.

It is a further object of this invention to provide a pallet protector which when assembled covers the entire periphery of the pallet to protect it from damage, while also protecting personnel from injury (e.g., splinters from a wooden pallet).

It is a further object of this invention to provide a pallet protector which when assembled covers the entire periphery of the pallet, but which may be removed in sections, to provide ready access to any side of the pallet.

It is a further object of this invention to provide a pallet protector formed of plural light weight, impact resistant guard members which are arranged to be readily interconnected with one another.

It is still a further object of this invention to provide a pallet protector which is of modular construction.

It is still a further object of this invention to provide a pallet protector which is of simple construction.

It is yet a further object of this invention to provide a pallet protector which is low in cost.

It is yet a further object of this invention to provide a pallet protector which is can be manufactured easily.

It is yet a further object of this invention to provide a pallet protector which may be color coded to provide the user information.

SUMMARY OF THE INVENTION

These and other objects of the instant invention are achieved by providing a pallet protector assembly for use with a conventional pallet, e.g., a wooden pallet having a plurality of stringers disposed generally parallel to one another underneath an upper deck. The upper deck is formed of plural spaced-apart deck-boards. The pallet is of a generally rectangular or square shape and has a pair of sides and a pair of ends.

The pallet protector assembly comprises plural elongated bar-like guard members. Each of the guard members has a pair of end portions. Each of the end portions includes a respective connector, e.g., one of the connectors of each of the guard members comprises a recess located in one end of the guard member, and the other of the connectors comprises a mating projection in the other end of the guard member. The connectors of respective ones of the elongated bar-like guard members are releasably securable to each other to form a self-supporting frame for encircling the periphery of the pallet and when so connected are resistant to accidental disconnection from one another.

In accordance with one preferred embodiment of the invention each of the guard members is formed of a light-weight, impact resistant material, such as polyethylene, polyolefin cellulose composite, or other plastics.

DETAILED DESCRIPTION OF THE PREFERRED EMBODIMENT

Referring to Figs. there is shown at 20 a pallet protector or guard assembly constructed in accordance with this invention and shown in its assembled state mounted about the periphery of a conventional pallet 10. The assembly 20 basically comprises a modular set of components, i.e., plural guard members (to be described later) which are arranged to be releasably secured to one another to form a peripheral wall which surrounds the pallet 10. This protective wall serves various purposes. For example, when in place it protects the pallet from injury which could otherwise result from the pallet being impacted by some piece of machinery, e.g., a fork-lift truck, or other object. Moreover, the pallet protector 20 also serves to protect personnel and others in the vicinity of the pallet from being injured by contact with the pallet, e.g., being injured by a splinter from the pallet.

Figure 1:
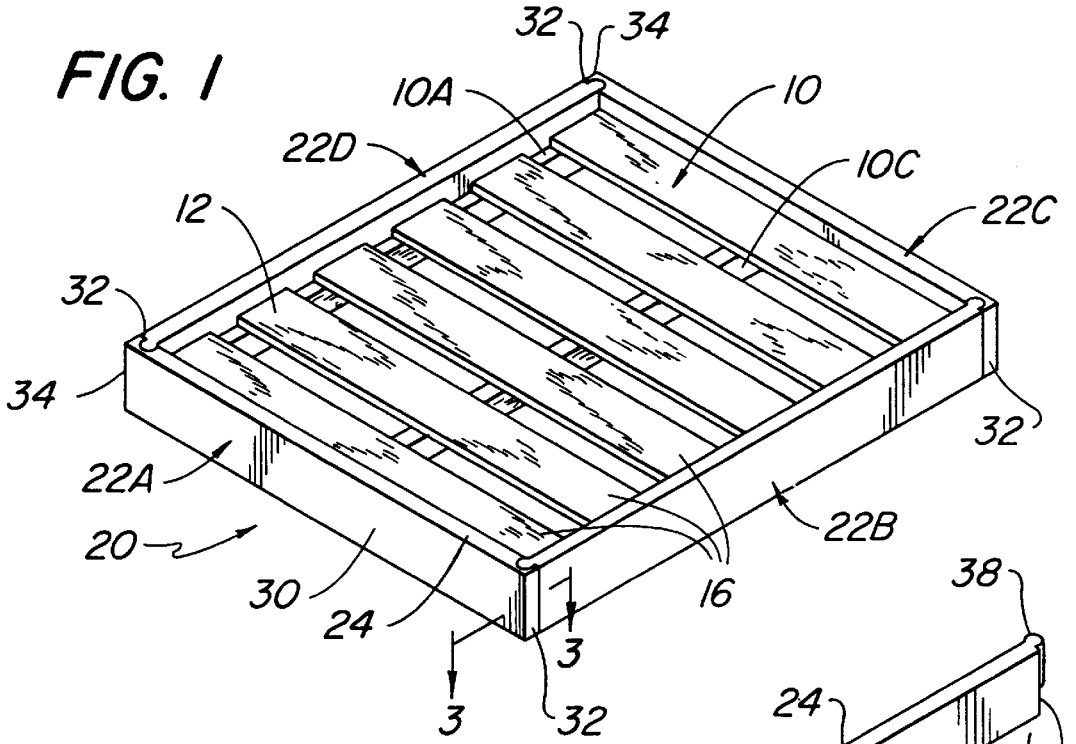
FIG. 1 is an isometric view of a pallet protector constructed in accordance with the subject invention being shown in place about the periphery of a conventional pallet, e.g., a single faced, flush-stringer wooden pallet.
Figure 2:
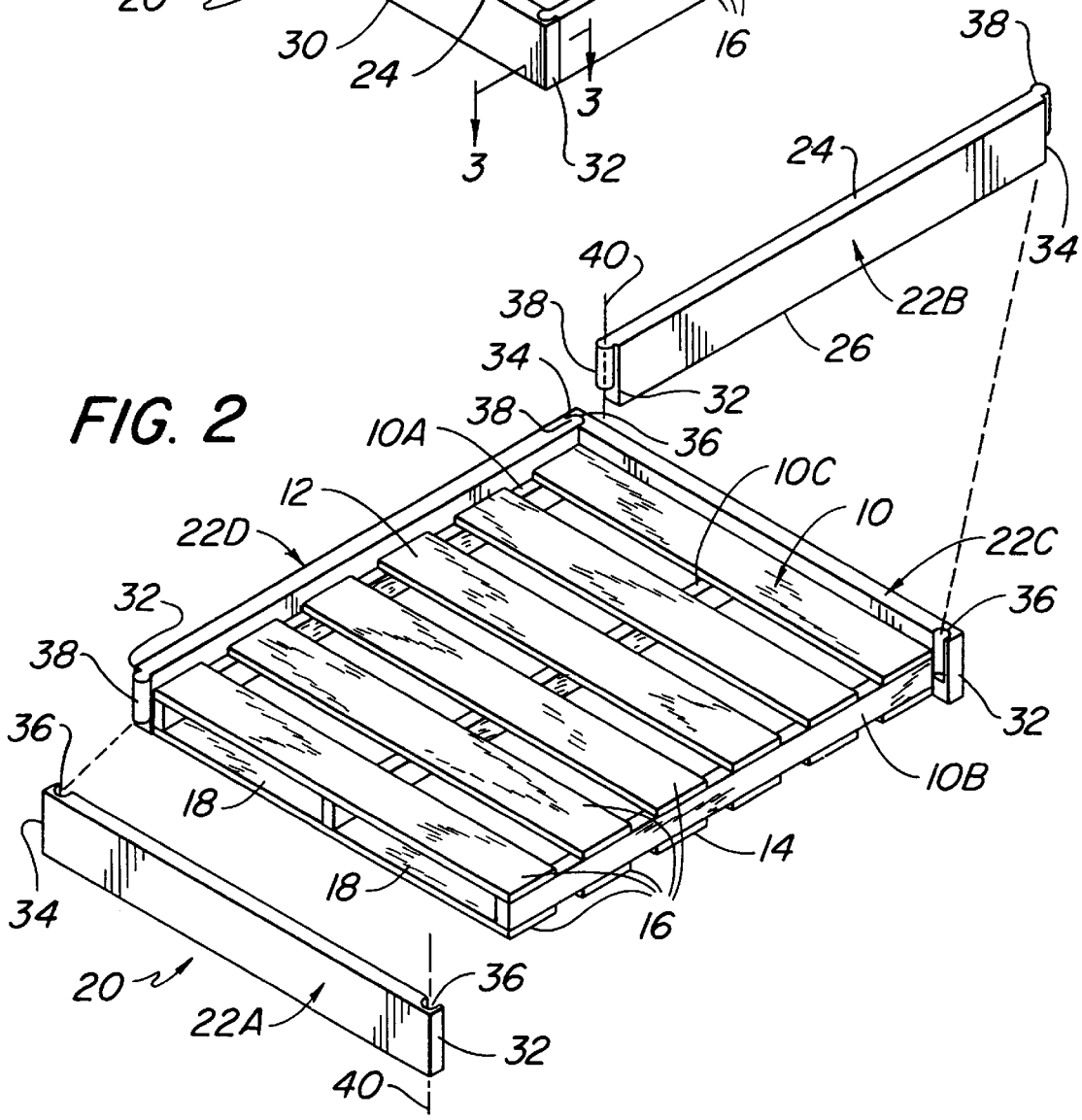
FIG. 2 is an exploded isometric view of the pallet protector shown in FIG. 1 but used with a reversible or double-faced, flush-type stringer wooden pallet.

Before discussing the pallet protector assembly 20 a brief description of the pallet 10 is in order. To that end as can be seen in FIG. 1 the pallet 10 may be of a single-face, flush-type stringer design, or a reversible or double-faced, flush-type stringer design as shown in FIG. 2. In the single faced embodiment of FIG. 1 the pallet includes plural, e.g., two, parallel outer stringers 10A and 10B, only one of which 10A can be seen in that figure, and a central stringer 10C. In the double faced embodiment of FIG. 2, the pallet also includes plural, e.g., two, parallel outer stringers 10A and 10B, and a central stringer 10C. In both embodiments the three stringers are elongated bar-like members disposed parallel and equidistantly to one another. The outer stringers define the two opposed sides of the pallet, with their respective ends defining the two opposed ends of the pallet. In the embodiment of FIG. 2 the stringers 10A, 10B and 10C are disposed between upper and lower decks 12 and 14, respectively. Each deck is made up of a plurality of spaced-apart deck-boards 16. In the embodiment of FIG. 1 the stringers 10A, 10B and 10C are disposed under an upper decks 12. Each deck of the embodiment of FIG. 1 and the upper deck of the embodiment of FIG. 1 is made up of a plurality of spaced-apart deck-boards 16. The deck-boards are fixedly secured to stringers by nails, screws, or other suitable fasteners. When so connected, the upper and lower decks and the stringers 10A, 10B, and 10C of the embodiment of FIG. 2 cooperate to define the a pair of side-by-side, lengthwise extending, open-ended passages 18 for receiving the tines of the fork of a fork-lift truck for facilitating load handling. In the embodiment of FIG. 1 the passageways have no bottom wall since there is no lower deck.

The pallet 10 is typically formed of wood, but may be formed of any durable, wear-resistant, load-supporting material. Examples of such other materials are plastics, metals, etc. As will be appreciated by those skilled in the art, conventional pallets 10 like those described above, while relatively low in cost and easy to fabricate, suffer from various disadvantage. The most significant disadvantages exist if the pallets are formed of wood, since such pallets tend to splinter or break relatively easily. This action may not only result in damage to the pallet to the extent at which it is no longer functional, but also could subject personnel who may come in contact with the pallet to injury from splinters. The pallet protector of this invention, while suitable for use on any type of pallet is particularly suitable for use with prior art wooden pallets to minimize, if not prevent, damage to pallet itself and to prevent splinter-induced injuries to personnel by shielding them from the sides and ends of the pallet.

As best seen in FIG. 2 the pallet protector 20, basically comprises a plurality, e.g., four elongated, bar-like, guard members 22A, 22B, 22C, and 22D. The guard member 22A and 22C are each of identical construction. The guard members 22B and 22D are of identical construction. All of the guard members are preferably hollow members having a top wall 24 (FIG. 4), a bottom wall 26, an inside wall 28, an outside wall 30, and end wall 32, and another end wall 34. The guard member can be formed of any suitable material, two particularly suitable ones being polyethylene and polyolefin cellulose composite, but other plastics or other non-plastic materials can be used as well so long as they are somewhat light in weight, durable, and impact resistant. Moreover, the guards need not be hollow, although that feature enables the guards to be quite light in weight for ease in handling. If the hollow guards formed of a plastic material are desired, they can be fabricated by either rotomolding, blow molding any other suitable process.

Each of the guard members 22A and 22C is arranged to be located on a respective end of the pallet. Thus, in one commercial exemplary embodiment of this invention each of those end guard members is dimensioned so that it's length as measured along its longitudinal axis is slightly longer, e.g., 1 inch longer, than the width, e.g., 40 inches, of the pallet 10 (the distance between the outer surface of the outside stringers 10A and 10B). Each of the guard members 22B and 22D is arranged to be located on a respective side of the pallet. Thus, in that exemplary commercial embodiment of this invention each of the side guard members 22B and 22D is dimensioned so that it's length as measured along its longitudinal axis is slightly longer, e.g., 1 inch longer, than the length, 48 inches, of the pallet 10 (the distance between the ends of the stringers. By so doing, the assembled guards form a frame which encircles, but is slightly spaced from the periphery of the pallet. The thickness, i.e., the distance between the surface of the inner wall 28 and the outer wall 30 of all of the guard members 22A, 22B, 22C and 22D, in the exemplary commercial embodiment is 1.5 inches. The height, i.e., the distance between the outer surface of the top wall 24 and the outer surface of the bottom wall 26, of all of the guard member 22A, 22B, 22C and 22D, in the exemplary commercial embodiment is 6 inches, so that each guard member's height is at least equal to the thickness of the pallet. It should be pointed out that such a construction is merely exemplary. Thus, in some cases it may be desirable to utilize guard members of a greater height than the height of the pallet, in some cases it may be desirable to utilize guard members of the same height as the pallet, and in other cases it may be desirable to utilize guard members of a lower height as the pallet.

As mentioned earlier each of the guard members is arranged to be releasably secured to another guard member so that all of the guard members can be connected together to form a hollow rectangular frame for encircling the periphery of the pallet 10. To that end, each of the end guard members 22A and 22C includes a respective female connector element 36. In particular, one female connector element 36 is located adjacent the end wall 32 of the guard member 22A. The other female connector element of the guard member 22A is located adjacent the opposite end wall 34. In a similar manner one female connector element 36 is located adjacent the end wall 32 of the guard member 22C. The other female connector element of the guard member 22C is located adjacent the opposite end wall 34. In a similar manner each end of the side guard members 22B and 22D includes a respective male connector element 38. In particular, one male connector element 38 is located adjacent the end wall 32 of the guard member 22B. The other male connector element of the guard member 22B is located adjacent the opposite end wall 34. In a similar manner one male connector element 38 is located adjacent the end wall 32 of the guard member 22D. The other male connector element of the guard member 22D is located adjacent the opposite end wall 34.

Each of the male connector elements 38 is in the form of a bulbous projection or tongue, whereas each of the female connector elements 36 is in the form of matingly shaped key-way or recess.

Figure 3:
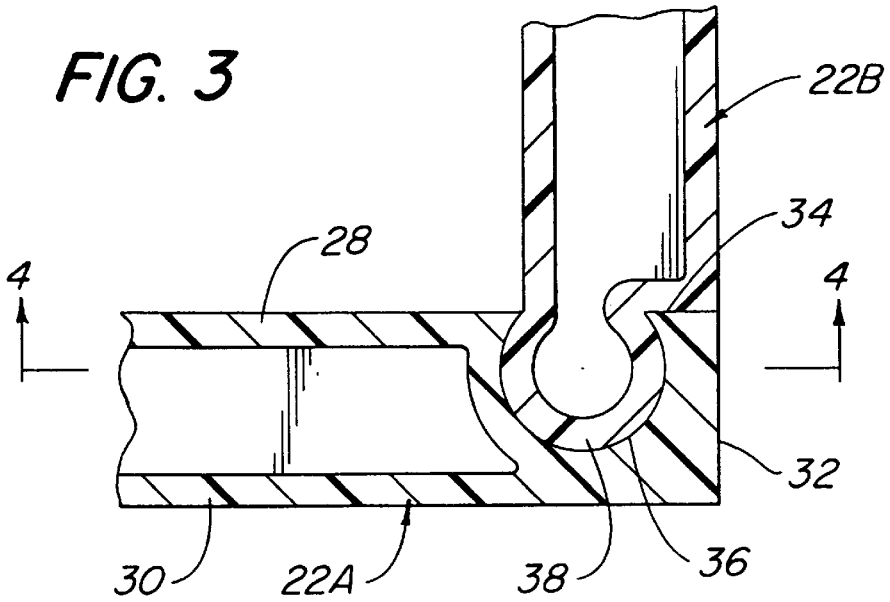
FIG. 3 is an enlarged sectional view taken along line 3—3 of FIG. 1.
Figure 4:
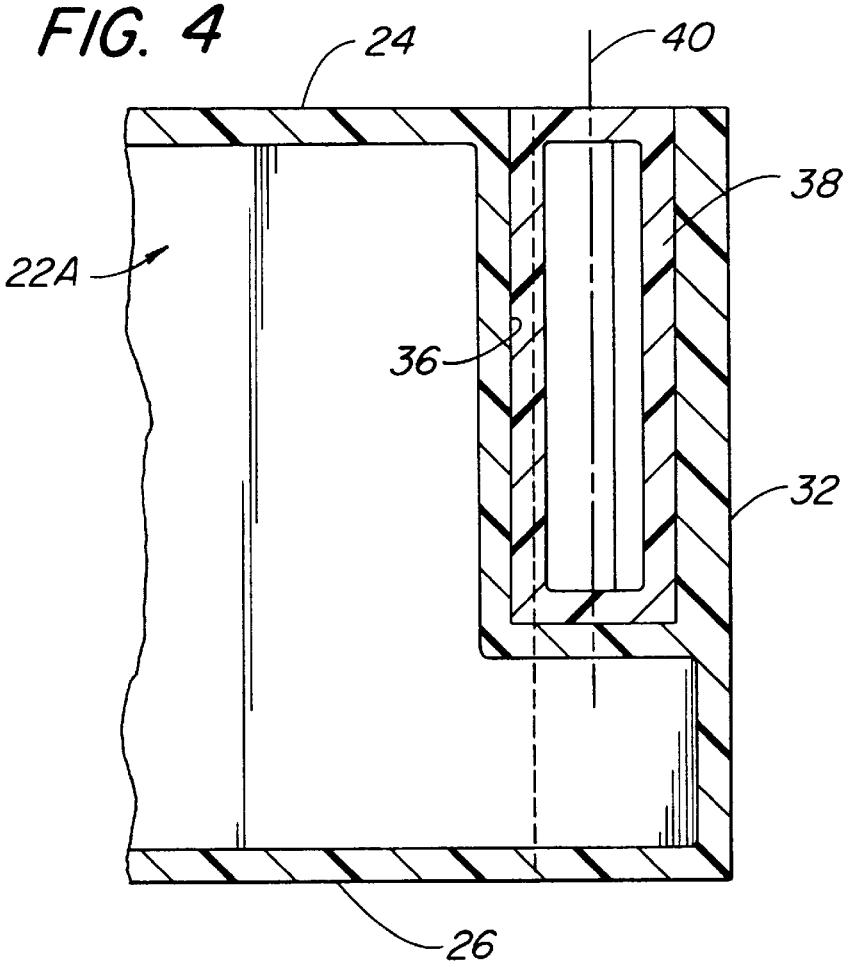
FIG. 4 is a sectional view taken along line 4—4 of FIG. 3.

As best seen in FIGS. 3 and 4 the tongue or projection connector element 38 adjacent the end wall 32 of the guard 22B is arranged to be releasably received within the key-slot or recess connector element 36 adjacent the end wall 32 of the guard member 22A to secure the guard member 22B to the guard member 22A. The tongue or projection connector element 38 adjacent the end wall 32 of the guard 22D is arranged to be releasably received within the key-slot or recess connector element 36 adjacent the end wall 34 of the guard member 22A to secure the guard member 22D to the guard member 22A. The tongue or projection connector element 38 adjacent the end wall 34 of the guard 22B is arranged to be releasably received within the key-slot or recess connector element 36 adjacent the end wall 32 of the guard member 22C to secure the guard member 22C to the guard member 22B. The tongue or projection connector element 38 adjacent the end wall 34 of the guard 22D is arranged to be releasably received within the key-slot or recess connector element 36 adjacent the end wall 34 of the guard member 22C to secure the guard member 22D to the guard member 22C.

Each of the bulbous tongue connectors elements 38 of the guard member 22A has a longitudinal axis 40 extending through it from the top wall to the bottom wall. The axis 40 is perpendicular to the longitudinal axis of that guard member and is also perpendicular to the plane of the pallet's upper deck 12. In a similar manner each of the bulbous tongue connectors elements 38 of the guard member 22C has a longitudinal axis 40 extending through it from the top wall to the bottom wall. The axis 40 is perpendicular to the longitudinal axis of that guard member and is also perpendicular to the plane of the pallet's upper deck 12. Each of the key-slot recess connector elements 36 of the guard member 22A also has a longitudinal axis 40 extending through it. That axis is perpendicular to the longitudinal axis of the guard 22A and is perpendicular to the plane of the upper deck of the pallet. In a similar manner each of the key-slot recess connector elements 36 of the guard member 22C also has a longitudinal axis 44 extending through it. That axis is perpendicular to the longitudinal axis of the guard 22C and is perpendicular to the plane of the upper deck of the pallet. Thus, the bulbous tongue connector 38 of the guard member 22B can be readily secured to the mating key-slot or recess connector element 36 of the guard member 22A by merely moving the two connector elements toward each other along their respective axes 40 and with those axes being axially aligned until the tongue 38 is fully within the key-slot 36. When so disposed the two mating connectors elements 36 and 38 are resistant to accidental disconnection in a direction parallel to the longitudinal axis of either of their guard members. However, the two connector elements 38 and 36 can be readily disconnected from each other to disconnect the guard members 22A and 22B by moving them away from each other in opposite directions along their co-aligned axes 40, until the tongue 38 is free from the recess 36. All of the other mating connector elements of the other guard members can be readily connected and disconnected in a similar manner.

When the guard members are connected as just described they form a rectangular, self supporting frame assembly. Moreover, as discussed above the guards members are dimensioned such that the spacing between the interior walls 28 of the guard members 22A and 22C is slightly greater to the spacing between the ends of the pallet, whereupon those interior walls 28 are spaced from the ends of the pallet's stringers. In a similar manner, the spacing between the interior walls 28 of the guard members 22B and 22D is slightly greater to the spacing between the sides of the pallet so that those interior walls 28 are spaced from the pallet's sides. Thus, when the guards are connected as just described they completely encircle and cover the ends and sides of the pallet, thereby protecting the pallet from impact-induced damage. If the pallet is formed of wood or some other material which may tend to splinter, the assembled protector assembly will prevent any person from coming in contact with the sides or ends of the pallet, thereby protecting the person from being injured by a splinter from the pallet.

In order to provide access to either end of the pallet to expose it's tine receiving open-ended passages 18 so that the tines of the fork of a fork-lift truck or a pallet jack may be inserted therein to lift or otherwise move the pallet, either of the guards 22A and 22C can be readily removed, leaving the remaining guards assembled, if desired. In particular, all that is necessary is to lift upward, i.e., parallel to the axes 40 of the connector elements 36, on the guard member 22A or 22C which is to be removed to free those connector elements from their mating engagement with the connector elements 38 of the two side guards 22B and 22D to which they had been releasably secured. Once the connectors are free from their mating engagement the guard 22A or 22C can be removed laterally, thereby leaving either the desired end of the pallet exposed. The pallet can then be lifted by the fork lift.

While the foregoing example has considered the removal of either of the end guards 22A and 22C, it is clear that any of the guard members can be readily removed to provide entry or access to any side or any end of the pallet. If side access of the pallet is desired, the pallet may include a pair of slots (not shown) in its outside stringers 10A and 10B for accepting the tines of a fork-lift or pallet jack.

It should be pointed out at this juncture that the pallet protector of this invention can be constructed so that each of its guard members includes a male connector element at one end and a female connector element at the other, each of which is arranged for releasable connection to a mating connector element of another guard member. Moreover, the guard members may all be of the same dimensions for use with square pallets. Thus, it should be clear that the size and shape of the guard members making up the pallet protector of this invention is a matter of choice. Moreover, the pallet protector or any portion of it can be colored or provided with suitable indicia to serve as some identification means, e.g., the guards can be colored to identify a particular department for which the pallet is to be used or to identify the material stored on the pallet.

As should be appreciated from the foregoing the pallet protector of this invention is simple in construction, can be manufactured at low cost, can be readily assembled and disassembled without the need for any tools, is light weight and readily transportable, and should exhibit a long life. By establishing a surrounding frame for any pallet the pallet protector of this invention serves to protect employees and customers from injuries related to exposed wood splinters while also preventing or minimizing damage to the pallet. Moreover, the clean lines of the assembled pallet protector should serve to dress up unsightly conventional wood pallets.

Without further elaboration the foregoing will so fully illustrate my invention that others may, by applying current or future knowledge, adopt the same for use under various conditions of service.

I claim:

1. A pallet protector assembly for use with a conventional pallet disposed on a support surface, the pallet having a plurality of stringers disposed generally parallel to one another underneath an upper deck, the deck being formed of plural spaced-apart deck-boards, the pallet having a predetermined height, a pair of sides, a pair of ends and corners between respective sides and ends, said pallet protector assembly comprising plural elongated bar-like guard members, each of said guard members having a pair of end portions, an inner surface and a bottom surface, each of said end portions including a respective connector, each of said connectors of respective ones of said guard members being integral therewith and releasably securable to an associated connector of another guard member to secure said guard members together without requiring the use of separate fasteners and to form a self-supporting frame that supports itself directly on the support surface, said self-supporting frame having an inner surface and plural right angle internal corners, said inner surface of said self-supporting frame being defined by said inner surfaces of said guard members, said self-supporting frame being arranged for disposition directly on the support surface by said bottom surface of each of said guard members for encircling the periphery of the pallet so that the corners of the pallet are located within respective ones of said internal corners of said self-supporting frame and the sides and ends of the pallet are disposed adjacent respective ones of said inner surfaces of said guard members, each of said guard members being approximately six inches (15.24 cm) in height and forming a substantially impenetrable barrier to deter the passing of an object therethrough into engagement with the pallet when the self-supporting frame encircles said pallet, said guard members being resistant to accidental disconnection from each other when said guard members are connected to one another to form said self-supporting frame.

2. The pallet protector assembly of claim 1 wherein any of said guard members may be removed from said frame, while leaving the remainder of said frame in place to provide access to any side or end of the pallet.

3. The pallet protector assembly of claim 1 wherein each of said guard members is formed of a light-weight, impact resistant material.

4. The pallet protector assembly of claim 3 wherein said material comprises a plastic.

5. The pallet protector assembly of claim 4 wherein said plastic is polyethylene.

6. The pallet protector assembly of claim 4 wherein said plastic is polyolefin cellulose composite.

7. The pallet protector assembly of claim 3 wherein each of said guard members is hollow.

8. The pallet protector assembly of claim 1 wherein at least one of said connectors of at least one of said guard members comprises a recess or key-slot located in one end thereof, and at least one of said connectors of at least another of said guard members comprises a mating projection located in one end thereof, and wherein said guard members are arranged to be releasably secured to each other by disposing said projection within said recess.

9. The pallet protector assembly of claim 8 wherein said projection is a bulbous tongue.

10. The pallet protector assembly of claim 8 wherein each of said guard members has a longitudinal axis and a transverse axis, said longitudinal axis extending in a plane generally parallel to the plane of the top deck-boards of the pallet, said transverse axis extending generally perpendicularly to the plane of the top deck-boards of the pallet, and wherein said recess and mating projection of said guard members which are connected together are resistant to accidental disconnection along said longitudinal axis, but are readily disconnectable along said transverse axis.

11. The pallet protector assembly of claim 10 wherein said projection is a bulbous tongue.

12. The pallet protector assembly of claim 10 wherein each of said guard members is formed of a light-weight, impact resistant material.

13. The pallet protector assembly of claim 12 wherein said material comprises a plastic.

14. The pallet protector assembly of claim 13 wherein said plastic is polyethylene.

15. The pallet protector assembly of claim 13 wherein said plastic is polyolefin cellulose composite.

16. In combination a pallet and a protector assembly therefor, said pallet having a plurality of stringers disposed generally parallel to one another underneath an upper deck, said pallet having a pair of sides, a pair of ends and corners between respective sides and ends, said pallet protector assembly comprising plural elongated bar-like guard members, each of said guard members having a pair of end portions, each of said end portions including a respective connector, each of said connectors of respective ones of said guard members being releasably securable to an associated connector of another guard member to form a self-supporting frame, said self-supporting frame having an inner surface and plural right angle internal corners, said inner surface of said self-supporting frame being defined by said inner surfaces of said guard members, said self-supporting frame encircling the periphery of said pallet with said corners of said pallet being located within respective ones of said internal corners of said self-supporting frame and with said sides and ends of said pallet being disposed adjacent respective ones of said inner surfaces of said guard members, said guard members being resistant to accidental disconnection from each other.

17. The combination of claim 16 wherein any of said guard members may be removed from said frame, while leaving the remainder of said frame in place to provide access to any side or end of said pallet.

18. The combination of claim 16 wherein each of said guard members is formed of a light-weight, impact resistant material.

19. The combination of claim 18 wherein said material comprises a plastic.

20. The combination of claim 19 wherein said plastic is polyethylene.

21. The combination of claim 19 wherein said plastic is polyolefin cellulose composite.

22. The combination of claim 19 wherein said pallet is formed of wood.

23. The combination of claim 16 wherein one of said connectors of one of said guard members comprises a recess or key-slot located in one end of said one guard member, and the other of said connectors comprises a mating projection in one end of another of said guard members, and wherein said guard members are arranged to be releasably secured to each other by disposing said projection within said recess.

24. The combination of claim 23 wherein said projection is a bulbous tongue.

25. The combination of claim 16 wherein each of said guard members has a longitudinal axis and a transverse axis, said longitudinal axis extending in a plane generally parallel to said upper deck, said tranverse axis extending generally perpendicularly to the plane of said upper deck, and wherein said recess and mating projection of each of said guard members which are connected together are resistant to accidental disconnection along said longitudinal axis, but are readily disconnectable along said transverse axis.

26. A pallet protector assembly for use with a conventional pallet disposed on a support surface, the pallet having a plurality of stringers disposed generally parallel to one another underneath an upper deck, the deck being formed of plural spaced-apart deck-boards, the pallet having a predetermined height, a pair of sides, a pair of ends and corners between respective sides and ends, said pallet protector assembly comprising plural elongated linear guard members, each of said guard members having a pair of end portions, a generally linear inner edge and a bottom surface, each of said end portions including a respective connector, each of said connectors of respective ones of said guard members being integral therewith and releasably securable to an associated connector of another guard member to secure said guard members together without requiring the use of separate fasteners and to form a self-supporting frame that supports itself directly on the support surface, said self-supporting frame having an inner surface and plural right angle internal corners, said inner surface of said self-supporting frame being defined by said inner edges of said guard members, said self-supporting frame being arranged for disposition directly on the support surface by said bottom surface of each of said guard members for encircling the periphery of the pallet so that the corners of the pallet are located within respective ones of said internal corners of said self-supporting frame and the sides and ends of the pallet are disposed adjacent respective ones of said inner surfaces of said guard members, each of said guard members being approximately six inches (15.24 cm) in height and forming a substantially impenetrable barrier to deter the passing of an object therethrough into engagement with the pallet when the self-supporting frame encircles said pallet, said guard members being resistant to accidental disconnection from each other when said guard members are connected to one another to form said self-supporting frame.

27. The pallet protector assembly of claim 26 wherein each of said guard members is formed of a light-weight, impact resistant material.

28. The pallet protector assembly of claim 27 wherein said material comprises a plastic.

29. The pallet protector assembly of claim 26 wherein at least one of said connectors of at least one of said guard members comprises an opening located in one end thereof, and at least one of said connectors of at least another of said guard members comprises a mating projection located in one end thereof, and wherein said guard members are arranged to be releasably secured to each other by disposing said projection within said opening.

30. The pallet protector assembly of claim 29 wherein each of said guard members has a longitudinal axis and a transverse axis, said longitudinal axis extending in a plane generally parallel to the plane of the top deck-boards of the pallet, said transverse axis extending generally perpendicularly to the plane of the top deck-boards of the pallet, and wherein said recess and mating projection of said guard members which are connected together are resistant to accidental disconnection along said longitudinal axis, but are readily disconnectable along said transverse axis.

* * * * *